United States Patent [19]

Nguyen et al.

[11] 4,423,700

[45] Jan. 3, 1984

[54] APPARATUS FOR COATING PLASTIC PIPE

[75] Inventors: Minh D. Nguyen, Englewood; Charles Lostak, Littleton, both of Colo.

[73] Assignee: J-M Manufacturing Company, Inc., Stockton, Calif.

[21] Appl. No.: 343,078

[22] Filed: Jan. 27, 1982

[51] Int. Cl.[3] ..... B05C 3/10

[52] U.S. Cl. ..... 118/404; 118/DIG. 11

[58] Field of Search ..... 118/404, DIG. 12, DIG. 11, 118/405, DIG. 18, 125; 427/434.7; 134/152, 170

[56] References Cited

U.S. PATENT DOCUMENTS

| | | | |
|---|---|---|---|
| 1,785,037 | 12/1930 | Martell et al. | 118/405 X |
| 2,331,983 | 10/1943 | Kaiser, Jr. | 118/404 |
| 2,649,757 | 8/1953 | Diamond | 118/404 |
| 4,063,617 | 12/1977 | Shenk | 118/405 X |

FOREIGN PATENT DOCUMENTS

| | | | |
|---|---|---|---|
| 528715 | 5/1939 | United Kingdom | 118/405 |

*Primary Examiner*—John P. McIntosh
*Attorney, Agent, or Firm*—L. David Rish

[57] ABSTRACT

In certain composite plastic pipe manufacturing operations it is necessary to provide an adhesive coating between the core pipe and the fiber glass reinforced layer, especially if the core pipe is a thermoplastic and the fiber glass reinforced material is a thermoset resin. In the disclosed coating apparatus (2), a coating chamber (4) is provided with seal means (20) at a first wall (14) and seal means (22) and a second wall (16), preferably a second chamber (40) is provided with a similar seal means (44). The coating chamber is maintained in a filled condition with a liquid coating material via a circulating pump (48) and associated reservoirs (34, 36, etc.). Rollers (62, 64) maintain the pipe sections in correct positional relationship with the coating apparatus. During operation, the pipe sections pass through the coating chamber and the second chamber providing a uniformly thin coating of adhesive material to the outside diameter of the pipe while minimizing loss of the coating material and volatization of the solvent component of the coating material in its liquid state.

1 Claim, 2 Drawing Figures

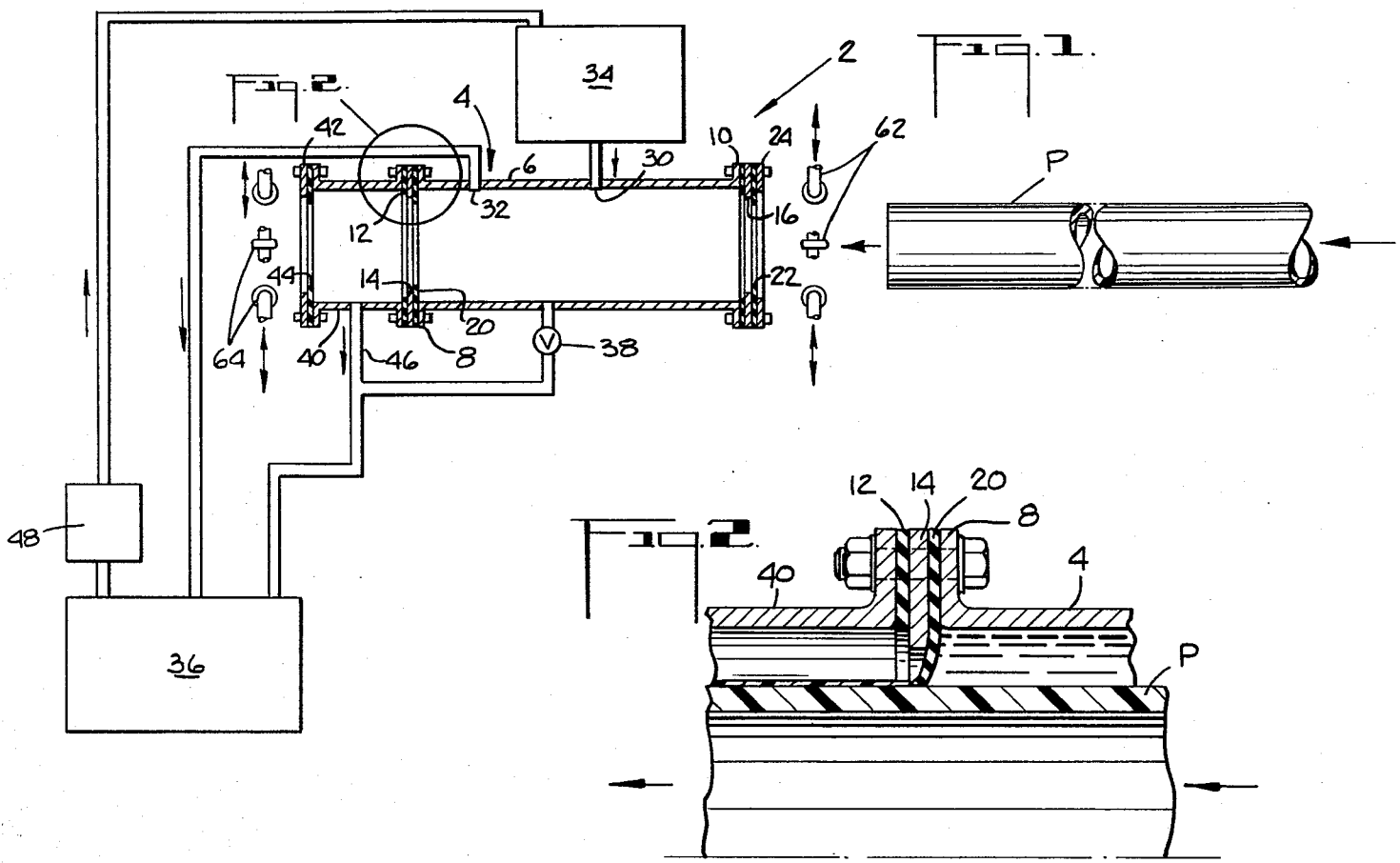
P
62
2
24
16
22
10
30
34
38
6
4
32
20
8
46
12
14
42
40
44
64
36
48
P
4
8
20
14
12
40

APPARATUS FOR COATING PLASTIC PIPE

BACKGROUND OF THE INVENTION

The present invention relates to the construction of composite plastic pipe, and in particular to apparatus for applying an adhesive coating or bonding layer to sections of thermoplastic pipe used as a core for subsequent overwrapping with a fiber glass reinforced thermoset layer.

Certain composite pipe constructions require this bonding layer between a fiber glass thermoset overwrap and the core pipe due to the mutual incompatibility of the base material and the reinforcing layer. In U.S. Pat. Nos. 3,628,991 and RE 29,375, two such adhesive compositions are disclosed. Generally, these adhesive materials are utilized in the form of a coating on the base material, usually a polyvinyl chloride (PVC) core pipe. This liquid coating material, which is an adhesive material dissolved in a mutual solvent of the adhesive material and of the PVC core pipe material, is applied in a manner to form a surface solution with the PVC core pipe material. This surface solution integrates the adhesive coating to the core pipe. Subsequent application of an epoxy impregnated fiber glass overwrap is adhered to the core pipe via the resulting coating. It has been the practice to apply this adhesive coating using a mechanical system. First, sections of the PVC pipe are attached one end to the other to form a series of such pipe sections. A highly volatile solvent, usually methyl ethyl ketone (MEK) is poured over the outside diameter of the pipe. This solvent is rubbed into the surface using a carpet pad, etc. Subsequently, the adhesive coating is spread over the MEK-treated surface of the pipe using a series of rotating brushes, carpet pads or a combination of the two. The resulting dried coating is subsequently used to bond the overwrap to the core pipe.

While the above-described mechanical system provided an adequate bonding layer on the adhesive material, there was considerable loss of the adhesive material through dripping and run-off. A great deal of highly volatile fumes were emitted. These fumes required a complex venting and incineration system to collect and destroy the resulting fumes and to comply with local air quality ordinances.

BRIEF DESCRIPTION OF THE INVENTION

The subject invention corrects the short comings by providing an apparatus for coating these axially aligned pipe sections with an adhesive coating or the like. This apparatus comprises a coating chamber for containing a liquid coating material, this chamber includes a first and a second opposed generally upright walls. Each of these walls has an opening large enough for the pipe sections to pass axially therethrough. Flexible seal means are sealingly attached over the apertures in these walls. Each seal means includes an aperture defining inner edge for conforming to the outside surface of the pipe sections when the sections are passed through the apertures and thus through the coating chamber. Rollers are positioned approximate the first and second walls for supporting the pipe sections in a predetermined positional relationship relative to the apertures. The apparatus also includes means for maintaining an amount of the liquid coating material in the coating chamber adequate to completely submerge all portions of the pipe sections in the coating chamber when the sections are passing through the chamber via these apertures. Preferably, the apparatus includes a second chamber defining a third generally upright wall opposed to the first upright wall of the coating chamber. This third upright wall includes an opening constructed to permit the pipe sections to pass therethrough and includes a third seal including an aperture defining inner edge for conforming to the outside surface of the pipe sections, this second chamber including a drain for removing from the second chamber any excess coating material which may leak past the seal means in the first upright wall of the coating chamber.

BRIEF DESCRIPTION OF THE DRAWINGS

FIG. 1 is a schematic view of an apparatus in accordance with the present invention.

FIG. 2 is a sectional view of a portion of FIG. 1.

DETAILED DESCRIPTION OF THE INVENTION

Referring to FIG. 1, coating apparatus 2 includes a coating chamber 4 generally consisting of horizontally oriented cylindrical portion 6 and bolt flanges 8 and 10. Attached to bolt flange 8 via sealing gasket 12 is first wall 14 which preferably comprises a metal flange. A similar construction is provided at bolt flange 10 in which a second wall 16 also preferably a metal flange is sealingly attached. A circular opening is defined in each of the first wall 14 and second wall 16 which is, of course, larger than the overall cross sectional shape of the pipe sections to be coated in the coating chamber.

Between bolt flange 8 and the first wall 14 is a flexible seal 20 which has an inner edge which in turn defines an aperture therethrough. Similarly, adjacent second wall 16 is flexible seal 22 which is held against the second wall 16 with a flange 24.

In the upper portion of cylindrical body 6 of the coating chamber are two fluid connections 30 and 32 which are in fluid communication with make-up tank 34 in the case of connection 30 and mix tank 36 in the case of connection 32. The mix tank 36 and make-up tank 34 are in turn in fluid connection via pump 48 which removes a liquid coating material from mix tank 36 and periodically replenishes the material in make-up tank 34.

Sealingly engaging the first wall 14 of the coating chamber 4 is a second chamber 40 which is constructed preferably in a manner similar to coating chamber 4. The second chamber 40 is sealed to the first wall 14 using a rubber gasket. The wall opposite the first wall 14 is defined by a metal flange 42 in a manner similar to the first wall and second wall. Between the body of the second chamber 40 and the wall 42 is a third seal 44, again constructed in a manner similar to the seals 20 and 22. Associated with the lower portion of second chamber 40 is drain 46 which terminates in mix tank 36.

Adjacent each end of the coating chamber (and by necessity, one end of the second chamber 40) are support rollers 62 and 64 respectively. These rollers are adjustably mounted. Rollers 62 preferably comprise four rollers stationed at the top, bottom and sides of the pipe sections P as they enter the coating apparatus. Rollers 64 comprise at least four rollers also positioned in a manner similar to the rollers 62. These support the pipe sections P as they exit the overall coating apparatus.

In operation, the various ingredients according to the known manner are mixed in the mix tank. As will be set forth in further detail, the mixing is carried out here with precision and the specific gravity of the material is precisely measured as the viscosity of the material is a function of the specific gravity. The viscosity is one parameter for controlling the thickness of the coating of the adhesive material on the pipe sections P. Pump 48 is operated to fill the make-up tank 34 and circulate the coating material to the coating chamber 4 via connection 30, out of the coating chamber 4 via connection 32 and back down to the mix tank 36. In this manner, the coating chamber 4 is maintained in a completely filled condition so that that portion of the pipe section is positioned between the seals 20 and 22 is completely submerged in the coating material. Also, the circulation of the material through the coater prevents rapid changes in the viscosity of the coating material. Viscosity is subject to change due to migration of the highly volatile solvents and volatization of these solvents during the coating process. The make-up tank 34 minimizes fluctuations in the pressure of the coating material in the tank which would otherwise result from operation of the pump 48. Thus the pressure of the coating material in the coating material in the coating chamber 4 is only hydrostatic pressure determined by the height of the make-up tank above the coating chamber 4. Generally this hydrostatic pressure is quite low, approximately 0.5 PSI. The drain valve 38 is normally not operated since this is used to shut down the system and purge the system of adhesive coating material.

As pipe sections P pass through the system (shown moving from right to left in FIG. 1) the flexible seal 22 conforms to the outside diameter of the pipe sections. Rollers 62 maintain the pipe section in a predetermined positional relationship with the seal 22. Preferably this positional relationship places the pipe section precisely in the center of the aperture in the seal 22 resulting in uniform deflection of the seal around the pipe section. The pipe sections exit the coating chamber 4 after being submerged in the coating material for a predetermined period of time (dwell time) as required for the particular chemistry involved. This dwell time in the coating chamber is a function of the length of the chamber and the rate of travel of the pipe sections. The dwell time is another parameter controlling the thickness of the coating on pipe section P. The dwell time can be easily determined for the particular application involved. Seal 20, in the first wall 14, conforms to the pipe wall in a similar manner to seal 22. The relationship of this seal to the pipe wall and the force exerted by this seal on the pipe wall is one of the main parameters that effects the resulting coating thickness on the pipe sections. Clearly, if the seal 20 is of too flexible a material, or the aperture defined therein is too large relative to the pipe section, too great an amount of the coating will remain after it passes through the aperture. If the material is too resistent to deflection or grips the pipe too tight because the aperture defined therein is too small, too little of the adhesive coating remains on the pipe. For the particular application involved with the preferred embodiment it has been found that the aperture in seal 20 (as well as the apertures and seals 22 and 44), need only be about ⅛ inch smaller in diameter than the diameter of the pipe for a pipe section having a diameter of 8 inches.

As the pipe sections move through the coating chamber 4, it is possible that a discontinuity in the outer surface of the pipe, such as a small scratch or a protrusion at the leading or trailing edge of each pipe section, may cause an excess amount of the coating material to pass between the seal 20 and the pipe wall. In this case, most of this excess material will drip off the pipe section or be removed at third seal 44. This excess material, while not very detrimental to the overall operation of the system, can be bothersome, especially when it is desired that the loss of material be minimized and the evolution of volatile materials be also minimized. Accordingly, drain 46 effectively removes this material and indeed permits its reuse via its connection to the mix tank 36. As the pipe sections exit this second chamber, the support rolls 64 maintain the correct positional relationship of the pipe sections throughout the overall coating apparatus. The pipe sections exit the overall apparatus having an uniformly thin and effective adhesive coating on the outer surface thereof.

Referring to FIG. 2, the function of the wall 14 is detailed. As FIG. 2 shows the first wall 14 as exemplary, this showing would apply equally well to the second wall 16 and third wall 42. Pipe section P in FIG. 2 is shown moving from right to left. The coating material C is shown flooding the outer surface of the pipe section P. Seal 20 is being deflected by the movement of the pipe section from right to left. The deflection, however, is controlled by the juxtaposition of the wall 14 immediately "downstream" of the seal 20. As the opening in the wall 14 is slightly larger than the aperture in the seal 20, this deflection is permitted but only to a controlled extent. In this way, a relatively flexible material, such as a relatively thin sheet of a known elastomer, such as ethylenepropylenediene (EPDM) rubber may be used in order to apply a uniform coating on the pipe, yet prevent an excess amount of the material from flowing out of the coating chamber 4.

In operation of an example of the preferred embodiment of the present invention, a liquid coating material comprising a fully reacted urethane resin, such as "ESTANE 5716®" resin available commercially from B. F. Goodrich Chemical Co., and an ABS (acrylonitrile-butadiene-styrene) copolymer in a ratio of 20/80 to 80/20 were dissolved in MEK. This material was coated on sanded core pipe sections. The impact resistance of the resulting epoxy impregnated fiber glass overwrapped core pipe sections was not significantly different than that of control pipe using the above coating material applied to solvent-washed core pipe section using the aforedescribed brush application system. Additionally, in using the inventive apparatus it has been found that material usage has been reduced by 55% over the material usage in the prior discussed mechanical application, for an equivalent amount of pipe sections coated. Accordingly, because the coating chamber floods the entire outer surface of the pipe section with the coating material, the pre-treatment of this surface using a volatile solvent such as MEK has been found to be completely unnecessary and that the bonding provided by the adhesive coating is effective. Due to the contained nature of the coating operation and the elimination of the MEK prewash, a complex incinerator system used to burn off the volatile fumes in the prior art coating system has been eliminated completely with great savings to fuel and maintenance costs.

I claim:

1. In an apparatus for coating a series of axially aligned rigid pipe sections with an adhesive coating or the like having a first coating chamber and a second coating chamber adjacent said first coating chamber for containing a liquid coating material, said first coating chamber having at least a first wall and a second wall, positioned opposed and generally upright, and said second chamber having said second wall and a third wall, each of said walls having a circular opening of sufficient diameter to permit said pipe sections to pass therethrough, wherein the improvement comprises:

(a) first, second, and third flexible sealing means sealingly attached across an opening with an inner diameter defining an inner edge which flexibly conforms to the outside surface of said pipe section when said pipe sections are guided through said circular openings;

(b) roller means adjustably mounted approximate said first and third walls for supporting said pipe sections in a predetermined positional relationship with said openings, whereby said seal means and said roller means co-operatively associate in combination to maintain the pipe section in a predetermined position within the coating chambers and cause said pipe section to be submerged in said adhesive coating material for a predetermined dwell time period;

(c) means for maintaining an amount of said liquid coating material in said first coating chamber adequate to completely submerge all portions of said pipe sections in said chamber when said sections are passing through said coating chambers via said openings;

(d) said second chamber positioned adjacent and after said first coating chamber relative to the direction of movement of said pipe sections and sealingly engaging said first coating chamber at said second upright wall and over said opening therein, said second coating chamber, having at least said third upright wall opposite said first wall permitting said pipe sections to pass therethrough and out of said second chamber;

(e) said third flexible seal means sealingly engaging said third wall across an opening with an inner diameter defining an inner edge which flexibly conforms to the outer surface of said pipe sections; and, (f) said second chamber including a drain means for removing any excess coating material from said second chamber, said drain means being operatively connected via forward conduits with a mix tank and a make-up tank means, each tank operatively connected to a pumping means for recirculating excess coating material out from said second chamber and back into said first chamber, whereby the coating material is evenly applied to the outer wall of the pipe for uniformity of coating.

* * * * *